US008447222B2

(12) United States Patent
Koido

(10) Patent No.: US 8,447,222 B2
(45) Date of Patent: May 21, 2013

(54) IMAGE FORMING UNIT WITH DEVELOPER COLLECTOR CONTACTING IMAGE CARRIER AT PREDETERMINED CONTACT PRESSURE, AND IMAGE FORMING DEVICE

(75) Inventor: Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 233 days.

(21) Appl. No.: 12/949,188

(22) Filed: Nov. 18, 2010

(65) Prior Publication Data

US 2011/0135360 A1 Jun. 9, 2011

(30) Foreign Application Priority Data

Dec. 3, 2009 (JP) ..... 2009-275853

(51) Int. Cl.
*G03G 21/00* (2006.01)
*G03G 15/01* (2006.01)

(52) U.S. Cl.
USPC ..... 399/350; 399/344

(58) Field of Classification Search
USPC ..... 399/344, 350
See application file for complete search history.

(56) References Cited

U.S. PATENT DOCUMENTS 4,500,196 A * 2/1985 Shimura ..... 399/35
4,888,262 A * 12/1989 Tamaki et al. ..... 430/58.05
4,931,841 A * 6/1990 Yoshihara ..... 399/347
5,752,151 A * 5/1998 Inoue et al. ..... 399/350
2002/0009304 A1* 1/2002 Kin et al. ..... 399/55
2002/0094214 A1* 7/2002 Yano et al. ..... 399/127
2002/0098013 A1* 7/2002 Kamimura ..... 399/167
2003/0219285 A1* 11/2003 Nakagawa ..... 399/281
2008/0187361 A1* 8/2008 Sakagawa et al. ..... 399/176
2009/0226229 A1* 9/2009 Tsunoda ..... 399/350

FOREIGN PATENT DOCUMENTS

JP A-04-093963 3/1992
JP A-2000-242057 9/2000
JP A-2005-010455 1/2005
JP A-2006-171100 6/2006
JP A-2007-279175 10/2007
JP 2009080436 A * 4/2009
JP A-2009-080436 4/2009
JP A-2009-204700 9/2009
JP A-2009-244856 10/2009

* cited by examiner

*Primary Examiner* — David Gray
*Assistant Examiner* — Tyler Hardman
(74) *Attorney, Agent, or Firm* — Posz Law Group, PLC

(57) ABSTRACT

An image forming device includes a plurality of image forming units each including a developer carrier that carries developer; an image carrier that forms a developer image on a surface layer with the developer supplied from the developer carrier; and a developer collector that is positioned to contact the surface layer of the image carrier and that removes residual developer after transferring the developer image formed on the surface layer onto a recording sheet. Wherein the developer collector in a first image forming unit has a higher linear contact pressure against the surface layer of the image carrier than that of other image forming units, and a thickness of the surface layer of the image carrier of the first image forming unit is greater than a thickness of the image carrier of the other image forming units.

22 Claims, 4 Drawing Sheets

IMAGE FORMING UNIT WITH DEVELOPER COLLECTOR CONTACTING IMAGE CARRIER AT PREDETERMINED CONTACT PRESSURE, AND IMAGE FORMING DEVICE

CROSS REFERENCE TO RELATED APPLICATION

The present application is related to, claims priority from and incorporates by reference Japanese Patent Application No. 2009-275853, filed on Dec. 3, 2009.

TECHNICAL FIELD

The present invention relates to an image forming unit and an image forming device used in copy machines, facsimile machines, printers and the like.

BACKGROUND

There are conventional image forming units and image forming devices that transfer special toner that is different from black, yellow, magenta and cyan color toner, such as coating toner that is applied on a surface of a recording sheet on which the color toners have been transferred. In such image forming units and image forming devices, an image forming unit may be provided to transfer transparent toner, which has a higher softening point and a larger average particle diameter than the color toner (black, yellow, magenta and cyan color toners) to the entire print areas of the color toners, as coating toner for adjusting glossiness of the printed matter that is obtained at the time of printing the color toners See for example Japanese Laid-Open Patent Application Publication No. 2009-80436 (paragraphs 0016-0032 and FIG. 1).

However, in the above-discussed conventional technology, the image forming unit that transfers the surface coating toner to recording sheets tends to degrade, or wear, relatively soon due to a higher frequency of use compared with the other image forming units for color toner.

That is because, when printing with the surface coating toner, an area on which the surface coating toner is applied is relatively large so that the greater wear, or reduction of the film thickness, of the photosensitive drum for the image forming unit that transfers the surface coating toner occurs compared with the photosensitive drums for the color toner image forming units In addition, because the image forming unit for the surface coating toner is downstream with respect to the color toner image forming units, reverse-transferred toner, which is the color toner adhering to the photosensitive drum of the surface coating toner image forming unit, increases. As a result, the amount of waste toner increases, frequently causing cleaning defects. An external agent of the waste toner often causes wear of the surface of the photosensitive drum.

SUMMARY

The present invention has an object to solve such problems. An image forming device of the present invention includes a plurality of image forming units each including a developer carrier that carries developer; an image carrier that forms a developer image on a surface layer with the developer supplied from the developer carrier; and a developer collector that is positioned to contact the surface layer of the image carrier and that removes residual developer after transferring the developer image formed on the surface layer onto a recording sheet. Wherein the developer collector in a first image forming unit has a higher linear contact pressure against the surface layer of the image carrier than that of other image forming units, and a thickness of the surface layer of the image carrier of the first image forming unit is greater than a thickness of the image carrier of the other image forming units.

The present invention as an advantage to prevent the time degradation (or aging) of the image forming unit that transfers the surface coating toner onto the recording sheet.

DETAILED DESCRIPTION OF THE EMBODIMENTS

Embodiments of the image forming unit and the image forming device according to the present invention are explained below with reference to the drawings. The present invention is not limited to the below descriptions but may be appropriately modified in a scope that does not depart from the concept of the present invention.

Figure 1:
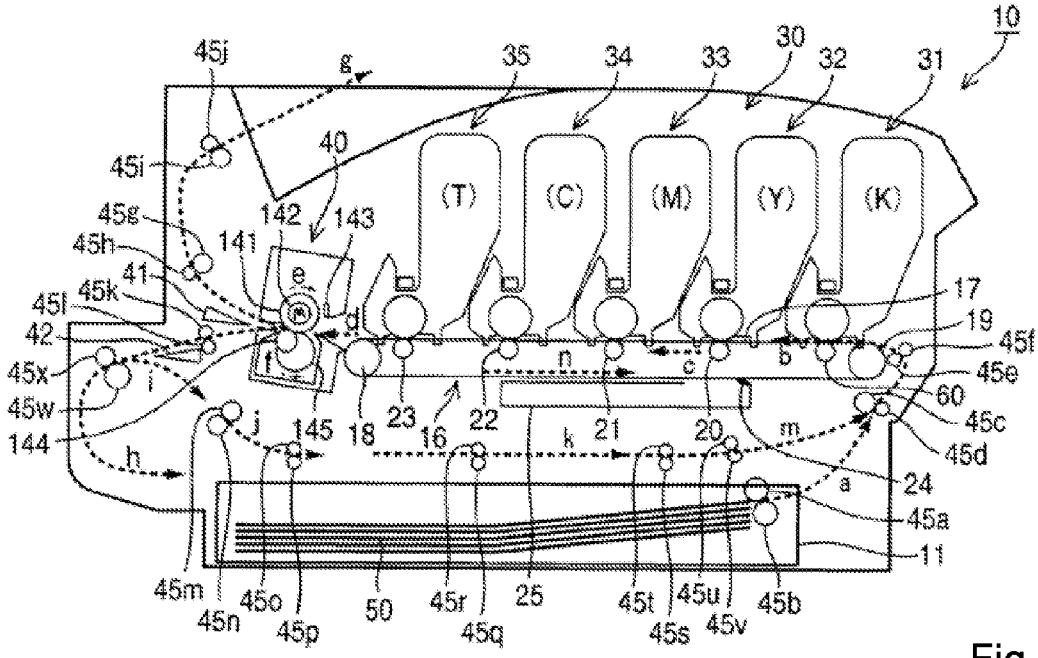
FIG. 1 is a schematic diagram showing a configuration of an image forming device according to a first embodiment.

(First Embodiment) FIG. 1 is a schematic diagram showing a configuration of an image forming device according to a first embodiment.

In FIG. 1, a printer 10, as an image forming device, has a configuration for a color electrophographic printer, for example, and includes a recording sheet cassette 11, image forming units 31-35, a transferring part 16 and a fuser 40. To carry recording sheets 50, which are the print media, to each of the above-described parts, the printer 10 further includes carrying rollers 45*a*-45*x* and carrying path switching guides 41 and 42.

The recording sheet cassette 11 stores the recording sheets 50 therein as they are stacked and is installed removably below the printer 10.

The carrying rollers 45*a* and 45*b* feed the recording sheets 50 stored in the recording sheet cassette 11 piece by piece from the top through a sheet carrying path in the direction indicated by an arrow a in FIG. 1. The carrying rollers 45*c* and 45*d*, and the carrying rollers 45*e* and 45*f* correct offset of recording sheets 50 while being carried in the direction of an arrow b in FIG. 1 and feed them to an image forming part 30.

The image forming part 30 is configured by the five image forming units 31-35, which are removable and are arranged along the sheet carrying path, and a transferring part 16, which transfers a developer image formed by each of the image forming units 31-35 as discussed below onto a surface of the recording sheets 50 by coulomb force.

The four image forming units 31-34, which are serially arranged, have the same configurations. That is, the only difference is the color of the developer. These image forming units are called color image forming units. In contrast, the surface coating (T) image forming unit 35, which coats the surface of the color developers transferred on the recording sheet 50, has a different configuration from that of the other color image forming units.

The transferring part 16 is configured from a transferring belt 17, which carries the recording sheets 50 by electrostatic adhesion, a drive roller 18, which is rotated by a drive part (not shown) to drive the transferring belt 17, a tension roller 19, which forms a pair with the drive roller 18 and applies tension on the transferring belt 17, transferring rollers 60 and 20-23, which are positioned to face and press the respective one of the later-discussed photosensitive drums in the image forming units 31-35 and apply electric voltage to transfer the developer images onto the recording sheets 50, a transferring belt cleaning blade 24, which cleans the transferring belt 17 by scraping off the developer adhered on the transferring belt 17, a waste developer tank 25, which stores the collected developer that is scraped off by the transferring belt cleaning blade 24.

Figure 2:
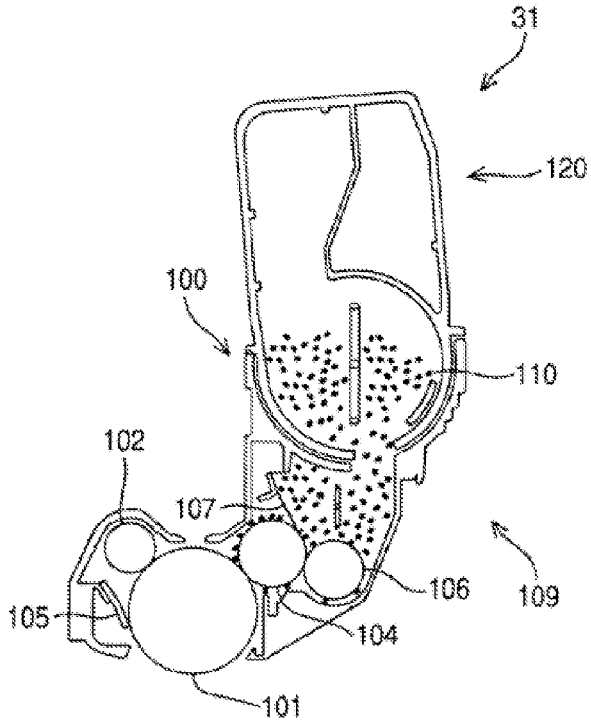
FIG. 2 is a schematic cross-sectional view showing a configuration of an image forming unit according to the first embodiment.
Figure 3:
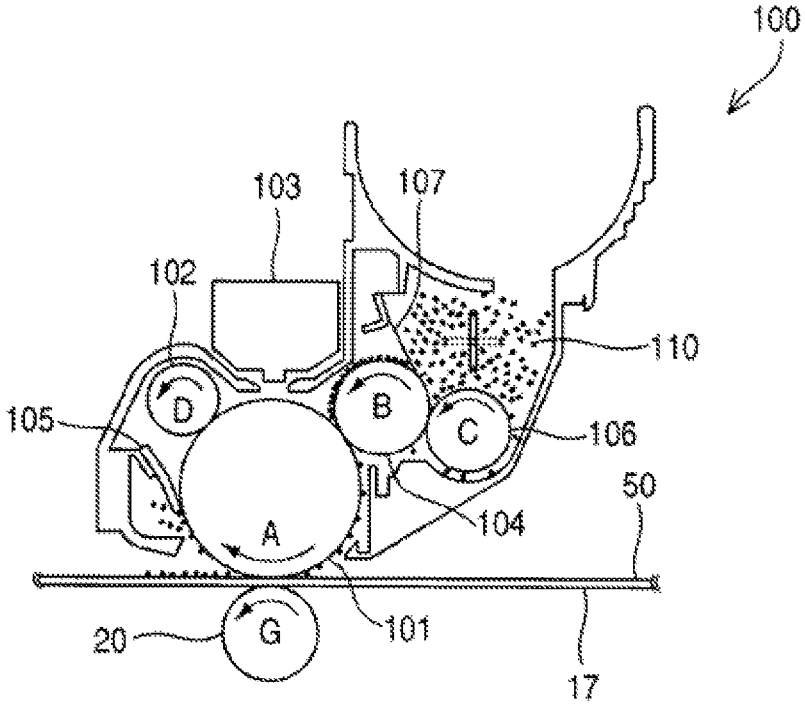
FIG. 3 is a schematic cross-sectional view showing a configuration of the image forming unit and a transferring part according to the first embodiment.
Figure 4:
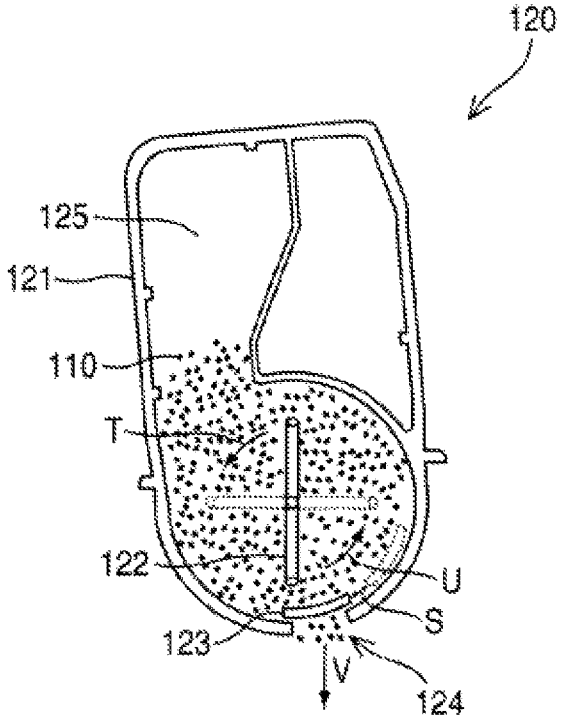
FIG. 4 is a schematic cross-sectional view showing a configuration of a developer container according to the first embodiment.

The configuration of the image forming unit 31 for the black (K) developer is explained based on the schematic cross-sectional view in FIG. 2, which shows a configuration of an image forming unit according to the first embodiment, a schematic cross-sectional view in FIG. 3, which shows a configuration of the image forming unit and a transfer part according to the first embodiment, and a schematic cross-sectional view in FIG. 4, which shows a configuration of a developer container according to the first embodiment.

Because the image forming unit 32 for the yellow (Y) developer, the image forming unit 33 for the magenta (M) developer and the image forming unit 34 for the cyan (C) developer have the same configuration as the image forming unit 31, their explanations are omitted. In addition, the image forming unit 35 for the surface coating (T) developer that coats the surface of the transferred color developer has differences in the developer color and the photosensitive drum, which is discussed later.

In FIG. 2, the image forming unit 31 is configured from a development device 109 formed by a development part 100 including a developing roller 104, a supply roller 106 and a development blade 107, and a developer container 120 that stores the developer 110. The image forming unit 31 also includes a photosensitive drum 101, a charge roller 102 and a cleaning blade 105.

The image forming unit 31 is installed at a predetermined position in the image forming part 30 and is removable, and the developer container 120 is installed with respect to the development part 100 and is removable.

Figure 5:
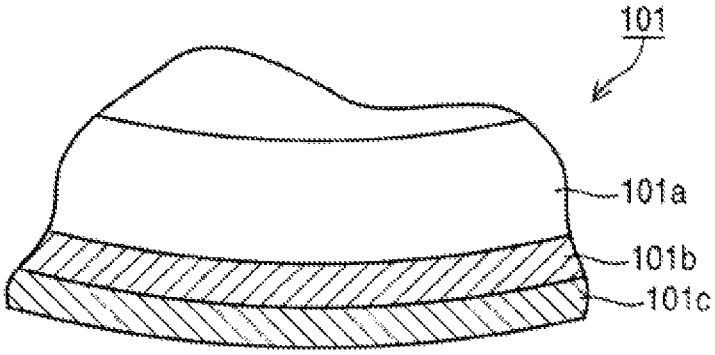
FIG. 5 is a schematic cross-sectional view showing a configuration of a photosensitive drum according to the first embodiment.

In FIG. 3, the photosensitive drum 101, which is an image carrier, is configured from a conductive base and a photoconductive layer as a surface layer. The photosensitive drum 101 is an organic photosensitive body having a configuration in which a charge generating layer 101*b* and a charge transporting layer 101*c*, which form a photoconductive layer, are sequentially laminated on a metal cylinder made of aluminum, which is the conductive base 101*a*, as shown in FIG. 5.

The charge roller 102, which is a charge device that uniformly charges the surface of the photosensitive drum 101, is provided to contact the circumferential surface of the photosensitive drum 101 and is configured by a metal shaft and a semiconductive epichlorohydrin rubber.

A light emitting diode (LED) head 103, which is an exposure device that forms an electrostatic latent image on the surface of the photosensitive drum 101, has an LED element and a lens array, for example, and is arranged at a position where illumination light outputted from the LED element forms an image on the surface of the photosensitive drum 101.

The developing roller 104, or developer carrier, transfers and supplies the developer to the photosensitive drum 101, is positioned to contact the circumferential surface of the photosensitive drum 101 and is configured by a metal shaft and a semiconductive urethane rubber layer.

The supply roller 106, or developer supplier, which makes sliding contact with the developing roller 104, is configured by a metal shaft and a semiconductive formed silicon sponge layer.

The development blade 107, which is a developer layer forming part that presses against the surface of the developing roller 104, is made of stainless steel. The cleaning blade 105, which is a developer collector, is pressed against the circumferential surface (surface layer) of the photosensitive drum 101 at a predetermined linear pressure and is made of urethane rubber.

As shown in FIG. 4, in a developer containing part 125 in a container 121 of the developer container 120, an agitating bar 122 that extends in a longitudinal direction of the developer containing part 125 is supported to rotate in the directions of arrows T and U, and an exit hole 124 that allows the developer 110 in the container 121 to escape in a direction of an arrow V is formed below the agitating bar 122.

A shutter 123 is provided in the container 121 and slides in the direction indicated by an arrow S to open and close the exit hole 124.

Returning to the explanation of FIG. 1, the recording sheet 50, on which the developer images in each color are transferred in the image forming part 30, is carried in the carrying path in the direction indicated by an arrow d and sent to the fuser 40.

The fuser 40 includes a heat generation roller 141, a pressure application roller 144, a thermister 143 and a heater 142.

The heat generation roller 141 is formed by covering a hollow cylindrical cored aluminum bar with a heat-resistant elastic layer formed by silicone rubber and then with a tetrafluoroethylene-perfluoroalkylvinylether copolymer (PFA) tube. Further, in the cored bar, the heater 142, such as a halogen lamp, is provided.

The pressure application roller 144 has a configuration, in which a cored aluminum bar is covered by a heat-resistant elastic layer formed by silicone rubber and then with a PFA tube, and is positioned to form the pressing part between the pressure application roller 144 and the heat generation roller 141

The thermister 143 is detecting surface temperature detecting means for the heat generation roller 141 and is positioned in the vicinity of the heat generation roller 141 in a non-contacting manner. Information of the temperature detected by the thermister 143 is transmitted to temperature control means (not shown). The temperature control means controls the turning on and off of the heater 142 based on the temperature information to maintain the surface temperature of the heat generation roller 141 at a predetermined temperature.

The recording sheet 50, on which the developer images have been fixed by the fuser 40, is carried in the direction indicated by an arrow g by the carrying rollers 45*g* and 45*h* and the carrying rollers 45*i* and 45*j* and is ejected outside the printer 10.

When printing a back side of the recording sheet 50 after a front side has been printed, a carrying path switching guide 41 is switched, and the recording sheet 50, on which the developer images have been fixed, is carried in the direction indicated by an arrow h by carrying roller 45*k* and 45*l* and carrying rollers 45*w* and 45*x*. After stopping the recording sheet 50, a carrying path switching guide 42 is switched, and the recording sheet 50 is carried in the directions indicated by arrows i, j, k and m by the carrying rollers 45*w* and 45*x* and carrying path rollers 45*m*-45*v*. Then, the recording sheet 50 is sent to the image formation part 30 again.

The cleaning blade and the transferring belt cleaning belt used in the present invention are normally formed by an elastic body, such as urethane rubber, epoxy rubber, acrylic rubber, fluorine resin rubber, nitrile-butadiene rubber (NBR), styrene-butadiene rubber (SBR), isoprene rubber (IR) and polybutadiene rubber.

The photosensitive drum used in the present invention is configured by laminating a charge generating layer with a charge generating substance and a binder resin as its main components and a charge transporting layer with a charge transporting substance and a binder resin as its main components on a conductive support body, such as aluminum, stainless steel, copper and nickel.

Various organic pigments and dyes are used for the charge generating substance. In particular, metal-free phthalocyanine; metal such as copper, indium chloride, gallium chloride, tin, oxytitanium, zinc and vanadium; their oxides; chloride-coordinated phthalocyanine; and azo pigment, such as monoazo, bisazo, trisazo and polyazo, may be used. Particles of the substance are used in a dispersion layer as they are bound with various binder resins, such as polyester resin, polyvinyl acetate, polyacrylic acid ester, polymethacrylic acid ester, polyester, polycarbonate, polyvinyl acetacetal, polyvinyl propional, polyvinyl butyral, phenoxy resin, epoxy resin, urethane resin, cellulosic ester, and cellulose ether.

For the charge transporting substrate, electron-releasing substituent including, for example, heterocyclic compound, such as carbazole, indole, imidazole, oxazol, pyrazole, oxydiazole, pyrazoline and thiadiazole; aniline derivative; hydrazone compound; aromatic amine derivative; stilbene derivative; or polymers formed by a group consisting of these substances in main or side chains, may be used. For the binder resin for the charge transporting layer, a vinyl polymer, such as polycarbonate, polymethyl methacrylate, polystyrene; polyvinyl chloride; polyester; polyester carbonate; polysulphone; polyimide; phenoxy; epoxy; silicone resin; copolymer of these substances; or partially cross hardened substance may be used alone or in combination. Polycarbonate is particularly suitable for the use. Moreover, various additives, such as antioxidant and sensitizer, may be added as needed.

As the developing roller used in the present invention, a member may be used that is generally used for developing rollers, in which a shaft formed by a conductive base, such as stainless steel, is covered by silicone rubber, urethane rubber or the like, of which electric resistance has been adjusted by carbon or the like, in an alternative of the above-described semiconductive urethane rubber layer.

For the development blade used in the present invention, a material may be used that is generally used for the development blades. For example, metal, such as stainless steel, or rubber, such as silicone rubber, may be used. Electric voltage may be applied if appropriate.

Next, the developers are discussed. The image forming device and the image forming units of the present invention include developer containers that contain the developers.

The developers for the present invention are formed by adding an external additive, such as inorganic particulate body, into toner base particles. The resultant material is referred to as toner. The material for the binding resin is not specifically limited. However, polyester resin, styrene-acrylic resin, epoxy resin and styrene-butadiene resin are preferable.

In addition, a release agent, a coloring agent and the like are added to the binding resin. In addition, additives, such as a charge controlling agent, a conductivity adjusting agent, a body pigment, a reinforcement filler, such as a fiber material, an antioxidizing agent, an antiaging agent, a flow improver and a cleaning improver, may be added is appropriate.

The material for the release resin is not specifically limited. For example, known materials, such as a low-molecular-weight polyethylene, a low-molecular-weight polypropylene, paraffin wax and carnauba wax, may be used. In addition, the release agent is preferably added in 0.1-30 parts by weight, and more effectively, in 0.5-20 parts by weight, for 100 parts by weight of the binding resin. Multiple kinds of waxes may be used together.

The material for the coloring agent used for the color toners is not specifically limited, and known materials may be used. Single or multiple kinds of dyes, pigments or the like, which are known to be used for the black, yellow, magenta and cyan toner coloring agents, may be used.

For example, carbon black, oxidized iron, phthalocyanine blue, permanent brown FG, brilliant fast scarlet, pigment green B, rhodamine-B base, solvent red 49, solvent red 146, pigment blue 15:3, solvent blue 35, quinacridone, carmine 6B and disazo yellow may be used. The coloring agent is added in 2-25 parts by weight, and more preferably, in 2-15 parts by weight, for 100 parts by weight of the binding resin.

Known materials may be used for the charge control agent, if necessary. For example, in the case of positively-charged toner, a quaternary ammonium salt charge control agent may be used, and in the case of negatively-charged toner, an azo complex charge control agent, a salicylic acid complex charge control agent, or a calixarene charge control agent may be used. These may be used solely or as combined with others.

For the external additive, in view of improvements in environmental safety, charge stability, development property, flowability and storage, inorganic or organic powder is preferably added to toner alone or in combination. The external additive is preferably made hydrophobic. Know materials can be used for the external agent. For example, silica powder or hydrophobic silica may be used. The external additive is effective when added in 0.5-6.0 parts by weight, and more preferably in 1.0-5.0 parts by weight.

For the method of manufacturing toner, a known method, such as pulverization method or polymerization method, may be used.

A toner that is used as developer in the image forming units 31-35 in FIG. 1 in the present embodiment is explained.

The toner base particles are obtained by the following process. For 100 parts by weight of bonding resin (polyester resin, number average molecular weight Mn=3700, glass transition temperature Tg=62° C., softening temperature $T_{1/2}$=115° C.), 0.5 parts by weight of Bontron (trademark) E-84 (produced by Orient Chemical Industries, Inc.) is added as the charge control agent. As a coloring agent, 5.0 parts by weight of Carbon Black (produced by Cabot Corp., MOGUL-L (registered mark)) for black toner, C.I. Pigment Yellow 74 (produced by Dainichiseika Color & Chemicals Mfg. Co., Ltd.) for yellow toner, C.I. Pigment Red 57:1 (produced by Dainichiseika Color & Chemicals Mfg. Co., Ltd., ECR-101) for magenta toner, and C.I. Pigment Blue 15:3 (produced by Dainichiseika Color & Chemicals Mfg. Co., Ltd., ECR-301) for cyan toner is added for the respective color toner. For the surface coating toner, 4.0 parts by weight of carnauba wax (produced by S. Kato & Co., carnauba wax 1 powder) is added. Then, after mixing by a Henschel mixer, the respective mixture is melt-kneaded by a biaxial extruder. After cooling the mixture, it is ground by an impact-type grinder and classified using a wind classifying machine.

Then, in an external additive process, for 100 parts by weight of the obtained toner base particles, 3.0 parts by weight of hydrophobic silica R972 (produced by Nippon Aerosil Co., Ltd., average primary grain size 16 nm) is added. The mixture is agitated by a Henschel mixer to obtain toner in five different colors.

Next, the photosensitive drums used in the image forming units 31-35 in FIG. 1 are explained.

With an aluminum pipe as a conductive base material, a bisazo compound is used for a charge generating substance for the charge generating layer, and a dispersion layer is formed by binding polyvinyl butyral as binder resin. The amount of the charge generating substance is 50 parts by weight for the binder resin. A hydrazone compound is used for a charge transporting substance for the charge transporting layer, and polycarbonate is used for the binder resin. Molecular mass of the binder resin is approximately 30000, and the amount of the charge transporting substance is 40 parts by weight for the binder resin.

In the present invention, a film thickness of a photoconductive layer (the charge generating layer 101*b* and the charge transporting layer 101*c* in FIG. 5), which is the surface layer of the photosensitive drum, is changed for the image forming units 31-34 and the image forming unit 35.

Effects of the above-described configuration are explained.

First, the operation of the image forming unit is explained based on FIG. 3.

In FIG. 3, the photosensitive drum 101 in a respective image forming unit of the printer is rotated by a drive means (not shown) at a certain circumferential speed in the direction indicated by the arrow A. The charge roller 102 provided to contact the surface of the photosensitive drum 101 applies a direct current voltage supplied by a charger roller high voltage power supply (not shown) onto the surface of the photosensitive drum 101, while being rotated in the direction indicated by the arrow D, thereby charging the surface uniformly.

Next, using the LED head 103 provided to face the photosensitive drum 101, the uniformly charged surface of the photosensitive drum 101 is irradiated with light that corresponds to image signals to optically attenuate electric potential of the irradiated portion and to form an electrostatic latent image.

The developer 110 is supplied to the developing roller 104 by the supply roller 106, to which a voltage is applied by a supply roller high voltage power supply (not shown).

The developing roller 104 is positioned to contact the photosensitive drum 101 (not shown) and is applied with a voltage by a developing roller high voltage power supply. The developing roller 104 adheres the developer 110 carried by the supply roller 106 that is rotated in the direction indicated by the arrow C and carries the developer 110 by rotation in the direction indicated by the arrow B. In this rotation-carrying process the development blade 107, which is downstream from the supply roller 106 and in pressure-contact with the developing roller 104, forms a developer layer, in which the developer 110 adhered on the developing roller 104 is caused to have a uniform thickness, on the developing roller 104.

Further, the developing roller 104 reverse-develops the electrostatic latent image formed on the photosensitive drum 101 by the supporting developer. Because a bias voltage is applied between the photosensitive drum 101 and the developing roller 104 by a high voltage power supply, an electrical flux line is caused between the developing roller 104 and the photosensitive drum 101 due to the electrostatic latent image formed on the photosensitive drum 101. As a result, the charged developer 110 on the developing roller 104 adheres on a part of the electrostatic latent image on the photosensitive drum 101 by the electrostatic force. This part is developed to form a developer image. The development process that starts at the commencement of rotation of the photosensitive drum 101 is initiated at the later-discussed predetermined timing.

Next, the operation of the entire printer is explained based on FIG. 1.

In FIG. 1, the recording sheets 50 stored in the recording sheet cassette 11 of the printer 10 are removed piece by piece in the direction indicated by the arrow a along a recording sheet guide (not shown). Then, the recording sheets 50 are fed to the transferring belt 17 that is rotated by the rotating drive roller 18 in the direction indicated by the arrow c. The above-described development process starts at a predetermined timing while the recording sheet s50 are carried in the direction indicated by the arrow a.

The transferring roller 60 for the black (K) image forming unit 31 is positioned to face the photosensitive drum 101 with a pressure contact via the transferring belt 17. A voltage is applied to the transferring belt 60 by a transferring roller high voltage power supply (not shown). The transfer process is achieved by the transferring roller 60 as the black developer image formed on the photosensitive drum 101 is transferred by the above-described development process onto the recording sheet 50 that is electrostatically adhered and carried on the transferring belt 17.

Thereafter, the recording sheet 50 is carried on the transferring belt 17 along the direction indicated by the arrow c. With the same processes as the development process and the transfer process by the image forming unit 31 and the transferring roller 60, the yellow developer image is transferred on the recording sheet 50 by the image forming unit 32 and the transferring roller 20. The magenta developer image is transferred on the recording sheet 50 by the image forming unit 33 and the transferring roller 21. The cyan developer image is transferred on the recording sheet 50 by the image forming unit 34 and the transferring roller 22. Then, the surface coating developer image is transferred on the recording sheet 50 by the image forming unit 35 and the transferring roller 23. The recording sheet 50, on which the developer image of each color has been transferred, is carried in the direction indicated by the arrow d.

The recording sheet 50, on which the developer image of each color has been transferred, is carried in the direction indicated by the arrow d in the figure and to the heat generating roller 141, the pressure application roller 144 and the pressure application belt 145. The recording sheet 50, on which the developer images have been transferred, enters between the heat generating roller 141, which surface is maintained at a predetermined temperature as controlled by a temperature control controller (not shown) and which is rotated in the direction indicated by the arrow e, and the pressure application roller 144 and the pressure application belt 145, which are rotated in the direction indicated by the arrow f. The heat of the heat generating roller 141 melts the developer images on the recording sheet 50. In addition, the developer images melted on the recording sheet 50 are pressed by the pressure contacting part between the heat generating roller 141, the pressure application roller 144 and the pressure application belt 145, to fix the developer images on the recording sheet 50.

The recording sheet 50, on which the developer images have been fixed, is carried in the direction indicated by the arrow g and is exited to the outside of the printer 10.

There is a case where a small amount of developer residue exists on the surface of the photosensitive drum 101 after transferring the developer images on the recording sheet 50. The developer residue is removed by the cleaning blade 105. For example, the cleaning blade 105 shown in FIG. 2 is parallel with the axis of the rotational shaft of the photosensitive drum 101. The base of the cleaning blade 105 is attached and fixed to a base frame of the image forming unit 31 so that the tip of the cleaning blade 105 contacts the surface of the photosensitive drum 101. The residue of the developer 110 on the surface of the photosensitive drum 101, which was not transferred and remained, is removed when the photosensitive drum 101 is rotated about the rotational shaft while the cleaning blade 105 is in contact with the circumferential surface of the photosensitive drum 101. The cleaned photosensitive drum 101 is repeatedly used.

In addition, in continuous sheet feeding, there is a case where a part of the developer with insufficient charge is transferred from the photosensitive drum 101 in each of the image forming units 31-35 onto the transferring belt 17 between the recording sheets. The developer transferred to the transferring belt 17 is removed from the transferring belt 17 by the transferring belt cleaning blade 24 and accumulated in the waste developer tank 25 while the transfer belt 17 is rotated and moves in the directions indicated by the arrows c and n. The cleaned transfer belt 17 is repeatedly used.

Next, tests in the present invention are explained.

First, the following test was conducted as Example 1-1.

In the printer 10 shown in FIG. 1, under room temperature environment (environment: temperature=25° C.; humidity=50%), the print speed of the device (linear speed of the photosensitive drum=sheet speed) is set to 252 (mm/s). The voltage applied to the charge roller is a constant voltage at −1000V for each image forming unit (31-35).

Figure 6:
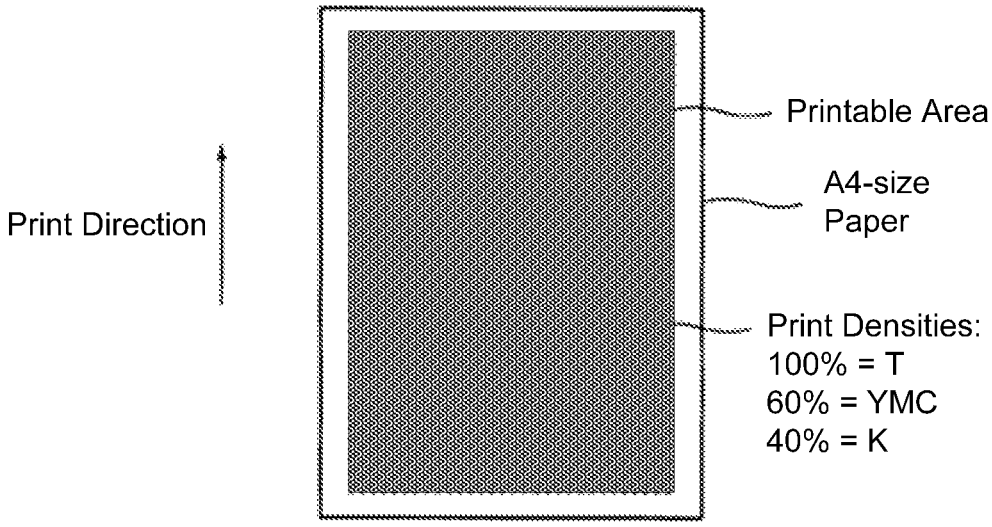
FIG. 6 is a diagram explaining a print pattern used for a continuous print test according to the first embodiment.

In the test, A4-size standard sheets (e.g., Excellent White by Oki Data Corp., basis weight=80 [g/m$^2$]) were fed in a portrait direction. The distance between sheets (a distance between a trailing end of a preceding sheet and a leading end of a subsequent sheet in a sheet feeding direction in continuous sheet printing) was set to 63 mm. A print pattern shown in FIG. 6 was used, which represents an average toner consumption rate during the printing of the surface coating toner (with a printable area that is a sheet surface without a 5 mm-boundary as 100%, the percentages of print area (print density) are: K (black)=40%, YMC (yellow, magenta and cyan) =60%, T (surface coating)=100%). With this print pattern, 50,000 sheets were continuously printed while supplying the toners and sheets. A film thickness and a surface electric potential of the photosensitive drums were measured before and after the continuous sheet printing.

The film thickness of the photosensitive drum (thickness of the charge generating layer 101*b* and the charge transporting layer 101*c* shown in FIG. 5) was measured by an eddy-current film thickness meter (LH-330J by Kett Electric Laboratory). With a base tube with only the conductive base material produced similarly to the conductive base material used for the photosensitive drum subject to the measurement as a reference (base tube film thickness $d_0$=0 μm), an average value of the measurements at five locations at equal spacing in the longitudinal direction of the subject photosensitive drum was defined as the film thickness of the photosensitive drum. The test was conduct with the photosensitive drums with a pre-test film thickness of 20 μm for the (T) image forming unit 35 and 18 μm for the (KYMC) image forming units 31-34.

The reason for the film thickness being 18 μm for the photosensitive drums for the (KYMC) image forming units 31-34 is to obtain excellent resolutions for the printed images and to obtain an appropriate life for the photosensitive drums. On the other hand, because resolution is not required for the images printed by the (T) image forming unit 35, the film thickness of the photosensitive drum is made thicker than that for the photosensitive drums for the (KYMC) image forming units 31-34.

Moreover, a rubber material made of urethane "#201708" produced by Hokushin Industry Inc. (Young's modulus=67 (kg/cm$^2$)) is used for the cleaning blade that contacts the surface layer of the photosensitive drum. The contact linear pressure of the cleaning blade on the photosensitive drum was adjusted by changing the attachment position of the cleaning blade. The contact linear pressure of the cleaning blade for the (T) image forming unit 35 was 29.4 N/m, and the contact linear pressure of the cleaning blade for each of the (KYMC) image forming units 31-34 was 19.6 N/m.

The contact linear pressure of the cleaning blade on the photosensitive drums was measured by the following method using a torque measuring device (LOAD TORQUE TESTER Model PT-1920 by Proctec Corp.).

Measuring conditions were: rotational speed of the photosensitive drum=139 rpm; sampling interval=0.01 sec.; and sampling time=5.0 sec. An average value of the result of sampling was outputted by connecting a personal computer to the above-described measuring device.

First, the cleaning blade, on the entire rubber part of which the toner was sprinkled, was contacted on the photosensitive drum, and a test image drum unit A (ID-A) device was configured from the cleaning blade, the photosensitive drum and the frame supporting the cleaning blade and the photosensitive drum. The torque of the photosensitive drum in the test ID-A device was measured in the above-described measurement conditions.

Next, a test image drum unit B (ID-B) device was configured from a photosensitive drum, to which a cleaning blade is not contacting, and a frame that supports that photosensitive drum. The torque of the photosensitive drum in the test ID-B device was measured in the above-described measurement conditions.

A result of subtraction of the torque of the photosensitive drum in the test ID-B device from the torque of the photosensitive drum in the test ID-A device was calculated as a torque (kgf·cm) from the effect of the cleaning blade.

The contact linear pressure (N/m) of the cleaning blade is defined from the following equation: contact linear pressure (N/m)=calculated torque (kgf·cm) from the effect of the cleaning blade×9.8/radius (cm) of photosensitive drum/length (m) of the cleaning blade in longitudinal direction In the present embodiment, the radius of the photosensitive drum was 1.5 cm, and the length of the cleaning blade in the longitudinal direction was 0.238 m.

The result of the present test is shown below in Table 1.

TABLE 1

| | | Transparent | Cyan | Magenta | Yellow | Black |
|---|---|---|---|---|---|---|
| Example 1-1 | Before Test | 20 | 18 | 18 | 18 | 18 |
| | After Test | 10 | 11 | 12 | 12 | 13 |
| | Film Reduction | 10 | 7 | 6 | 6 | 5 |

The amount of film reduction of photosensitive drum for each color was larger with the photosensitive drums positioned more downstream in the sheet passing direction and with a higher print density. From this result, the amount of reverse-transferring toner collected by the cleaning blade was larger when the photosensitive drum was further downstream. This led to an assumption that the external additive in the toner wears the photosensitive drum and scrapes the surface of the photosensitive drum. In addition, the fact that the contact linear pressure of the cleaning blade on the photosensitive drum was higher with the (T) image forming unit 35 may have contributed to the result. Image defects were not found in the printed image after printing 50,000 sheets.

Next, the following test was conducted as Example 1-2.

The film thickness of the photosensitive drum for the (T) image forming unit was changed from 20 μm in Example 1-1 to 30 μm. The other conditions remained the same as Example 1-1 to conduct the test.

The result of the test is shown under "Example 1-2" in Table 2. The amount of reduction of the film of the photosensitive drum in the (KMYC) image forming units 31-34 was similar to the result of Example 1-1.

The film thickness of the photosensitive drum before the test was 18 μm, and the surface potential was −550V. Image defects were not found in the printed images immediately after commencement of the test (see Initial Image Quality ○). With the printed image after the test, the surface coating toner was developed on the edges that are the non-print areas on the recording sheet, and uneven glossiness appeared on the edges, resulting image defects (see Image Quality After Continuous Print Test ×). Moreover, the surface coating toner was transferred to the transferring belt 17 after passing the (T) image forming unit 35. The surface coating toner was applied from the image forming unit without any control. The film thickness of the photosensitive drum at that time was 8 μm, and the surface potential was −320V. As a result, it is assumed that, because the film of the photosensitive drum became too thin, and because insulation breakdown occurred in parts of the photosensitive drum, the surface coating toner failed to adhere and escaped, causing unnecessary toner consumption.

TABLE 2

| | Film Thickness of Photosensitive Drum (μm) | | | Surface Potential of Photosensitive Drum (V) | | Initial Image Quality | Image Quality After Continuous Print Test |
|---|---|---|---|---|---|---|---|
| | Before | After | Film Reduction | Before | After | | |
| Example 1-1 | 20 | 10 | 10 | −540 | −590 | ○ | ○ |
| Example 1-2 | 30 | 20 | 10 | −460 | −540 | ○ | ○ |
| Comparative Example 1-1 | 18 | 8 | 10 | −550 | −320 | ○ | X |
| Comparative Example 1-2 | 32 | 22 | 10 | −400 | −520 | X | ○ |
| Comparative Example 1-3 | 30 | 22 | 8 | −460 | −520 | ○ | X |

For the (T) image forming unit 35, surface potential of the photosensitive drum was also measured in addition to the amount of film reduction of the photosensitive drum.

The surface potential of the photosensitive drum was measured using a surface potential meter (Model 1344 by Trek, Inc.) and a probe (Model 1555P-4 by Trek Inc.). The surface potential of the photosensitive drum 101 was measured for one turn of the photosensitive drum 101 at five locations at equal spacing in the longitudinal direction between the charge roller 102 and the LED head 103 shown in FIG. 3, and an average value was calculated.

The film thickness of the photosensitive drum before the test was 30 μm, and the surface potential was −460V. Image defects were not found in the printed images immediately after commencement of the test (see Initial Image Quality ○). The film thickness of the photosensitive drum after the test was 20 μm, and the surface potential was −540V. Image defects were not found in the printed images after the test, either (see Image Quality After Continuous Print Test ○). In Example 1-2, similar to Example 1-1, the amount of reduction of the film was 10 μm. The reason for the larger surface potential of the photosensitive drum 101 after the test is assumed to be that the electrostatic capacity increased due to the reduced film thickness.

Next, in Comparative Example 1-1, the test was conducted with the film thickness of the photosensitive drum in the (T) image forming unit at 18 μm. The other conditions were similar to those in Example 1-1. The result is shown under "Comparative Example 1-1" in Table 2. The amount of film reduction in the (KYMC) image forming units 31-34 was similar to that in the result of Example 1-1.

Next, in Comparative Example 1-2, the test was conducted with the film thickness of the photosensitive drum in the (T) image forming unit at 32 μm. The other conditions were similar to those in Example 1-1. The result is shown under "Comparative Example 1-2" in Table 2. The amount of film reduction in the (KYMC) image forming units 31-34 was similar to that in the result of Example 1-1.

The film thickness of the photosensitive drum before the test was 32 μm, and the surface potential was −400V. With the printed image immediately after starting the test, the surface coating toner was developed on the non-print areas on the recording sheet, and uneven glossiness appeared, resulting image defects (see Initial Image Quality ×). Moreover, the surface coating toner was transferred on the transferring belt 17, causing the toner to be exited from the (T) image forming unit 35. After continuing the test as is, the uneven glossiness disappeared in the middle of the continuous sheet print. Image defects did not occur in the printed images after the test (see Image Quality After Continuous Print Test ×).

The film thickness of the photosensitive drum after the test was 22 μm, and the surface potential was −520V. The large surface potential after the test is assumed to be resulted from an increased electrostatic capacity as the film thickness was reduced.

Next, in Comparative Example 1-3, the test was conducted with the film thickness of the photosensitive drum in the (T) image forming unit at 30 μm and the contact linear pressure of the cleaning blade at 19.6 N/m. The other conditions were similar to those in Example 1-1. The result is shown under "Comparative Example 1-3" in Table 2. The amount of film reduction in the (KYMC) image forming units 31-34 was similar to that in the result of Example 1-1.

The film thickness of the photosensitive drum before the test was 30 μm, and the surface potential was −460V. Because the contact linear pressure of the clearing blade was 19.6 N/m, insufficient cleaning of the transfer residual toner occurred during the print test and after the continuous printing (see Image Quality After Continuous Print Test ×). The toner that was not removed by the cleaning blade adhered to the charge roller, causing insufficient and uneven charge on the photosensitive drum. This resulted image defects due to uneven glossiness. In addition, the toner moved on the photosensitive drum in the non-print area of the printed image (e.g., between sheets). Therefore, the surface coating toner was unnecessarily consumed.

When the insufficient cleaning of the transfer residue occurs, the toner, which is an insulating substance, is adhered on the charge roller, causing insufficient charging of the charge roller. In addition, the charge on the photosensitive drum becomes uneven. Therefore, the toner layer thickness of the surface coating toner image on the photosensitive drum becomes uneven. As a result, uneven glossiness on the printed image occurs.

The film thickness of the photosensitive drum after the test was 22 μm (amount of film reduction=8 μm), and the surface potential was −520V. The reason for the lower amount of film reduction compared with Comparative Examples 1-1 and 1-2 is because of the lower contact linear pressure of the cleaning blade. The reason for the increased surface potential after the test is assumed to be the result of increased electrostatic capacity due to a lower film thickness.

From the above results, the surface coating image forming unit requires more toner to be consumed compared with the other colors due to its purpose. In addition, because it is printed on the uppermost layer, the amount of waste toner also increases. Therefore, it is necessary to press the cleaning blade for the surface coating image forming unit with higher linear pressure. As a result, by configuring the film thickness of the photosensitive drum for the surface coating image forming unit at 20-30 μm, a surface coating image forming unit is obtained with a life equal to or greater than that for the photosensitive drums for the other color image forming units. Because the resolution can be low for the surface coating toner for its purpose, the film thickness of the photosensitive drum can be increased compared with those for the other colors.

Further, in the above embodiment, the tests were conducted by performing the printing at a 100% print density using the LED head for the surface coating image forming unit. However, the LED head in the surface coating image forming unit may be removed. In that case, the voltage applied to the charge roller may be set at 0V when printing the surface coating toner (in this case, the surface coating toner is supplied onto the charge roller), and the voltage of −1000V may be applied to the charge roller when the printing is not needed, such as between sheets (in this case the surface coating toner is not supplied to the charge roller). By doing so, the supply of the surface coating toner to the charge roller, that is, the printing of the surface coating toner can be switched on and off.

As explained above, with the first embodiment, by setting the film thickness of the photosensitive drum for the surface coating image forming unit at 20-30 μm, there is an advantage to extend the life of the photosensitive drum for the surface coating image forming unit equal to or longer than that of the photosensitive drums for the other color image forming units.

(Second Embodiment) The configuration of the image forming unit in the second embodiment is different from the configuration in the first embodiment in that a solenoid 1041 is provided at a shaft bearing on both sides of the developing roller 104 to cause the developing roller 104 to move toward and away from the photosensitive drum 101, so that the developing roller 104 can be alternately separated from and placed in contact with the photosensitive drum 101.

Figure 7:
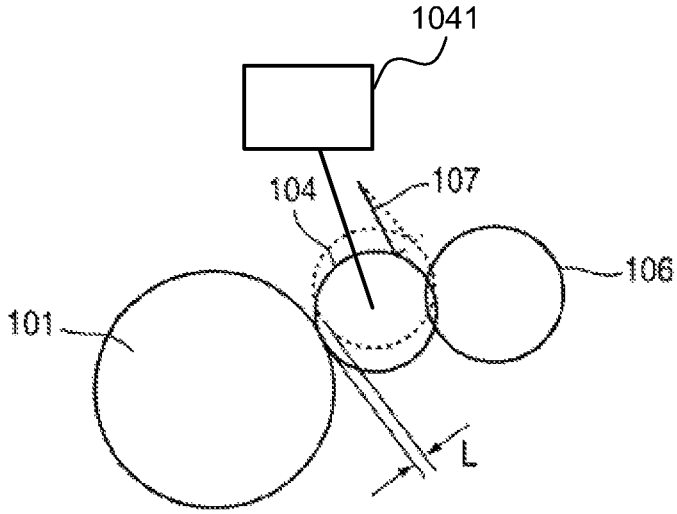
FIG. 7 is an explanatory diagram showing a positional relationship of a photosensitive drum and a developing roller according to a second embodiment.

FIG. 7 is an explanatory diagram showing a positional relationship of the photosensitive drum 101 and the developing roller 104 in the second embodiment.

As shown in FIG. 7, when separated, the developing roller 104 and the development blade 107 move to a position indicated by the broken lines. The developing roller 104 is separated from the photosensitive drum 101 during non-printing periods, which are mainly periods between sheets during the continuous printing and idle times before and after the operation. The spacing for the separation is defined as L mm at the smallest distance between the surface of the photosensitive drum 101 and the surface of the developing roller 104. The developing roller 104 and the photosensitive drum 101 contact each other only for the time corresponding to the print area on the sheet, that is, while the surface coating toner is being developed on the photosensitive drum 101.

By the solenoid 1041, the developing roller 104 and the photosensitive drum 101 in the surface coating image forming unit 35 can be freely separated and contacted.

Effects of the above-described configuration are explained.

The developing roller 104 and the photosensitive drum 101 are separated by the actuation of the solenoid 1041 when not printing, that is, between sheets during the continuous printing and at the time of idling and stopping before and after the operation. The developing roller 104 and the photosensitive drum 101 contact each other only for the time corresponding to the print area on the sheet, that is, while the surface coating toner is being developed on the photosensitive drum 101.

The other operations are the same as those in the first embodiment.

In the sheet test in the above-described Example 1-1, the developing roller and the photosensitive drum in the surface coating image forming unit contact each other for a time corresponding to the passage of the print area of a single sheet, to which the surface coating toner is transferred, at the time of performing the print test for 50,000 sheets, to continue developing the surface coating toner from the developing roller to the photosensitive drum.

Thereafter, the developing roller and the photosensitive drum are separated from the time immediately after the surface coating toner develops the surface coating toner in the area on the photosensitive drum that corresponds to a trailing end of the print area of a first recording sheet to which the surface coating toner is transferred. The developing roller and the photosensitive drum continue to be separated until a part on the photosensitive drum that corresponds to the leading end of the print area of a second recording sheet to which the surface coating toner is transferred.

Similarly, the developing roller and the photosensitive drum contact each other in the part of the photosensitive drum that corresponds to the area in the print area of the second recording sheet to which the surface coating toner is transferred. As a result, the surface coating toner continues to be developed from the developing roller to the photosensitive drum.

After that, the developing roller and the photosensitive drum are separated from the time immediately after the surface coating toner develops the surface coating toner in the area on the photosensitive drum that corresponds to the trailing end of the print area of the second recording sheet to which the surface coating toner is transferred. The developing roller and the photosensitive drum continue to be separated up to a part on the photosensitive drum that corresponds to the area at the leading end of the print area of a third recording sheet to which the surface coating toner is transferred.

The continuous print test was performed for 50,000 sheets by repeating the above-described operations.

As a result, the 20 μm film thickness of the photosensitive drum before starting the test became 12 μm after the test, which resulted in 8 μm in the amount of film reduction. Moreover, image defects were not found in the printed images before or after the test.

In the above-described Example 1-1, in which the photosensitive drum and the developing roller are not separated, the amount of film reduction was 10 μm, compared with 8 μm in the amount of film reduction in the present embodiment. Therefore, the amount of film reduction is more suppressed compared with the first embodiment.

As discussed above, in the second embodiment, the amount of film reduction for the photosensitive drum can be suppressed by separating the developing roller and the photosensitive drum between sheets during the continuous printing, compared with the case where the recording sheets are continuously fed while the developing roller and the photosensitive drum contact each other. As a result, there is an advantage that the life of the surface coating image forming unit can be extended.

(Third Embodiment) The third embodiment is configured by using individual motors for driving the rotation of the photosensitive drum and the developing roller for the surface coating image forming unit and by rotating the photosensitive drum and the developing roller at different circumferential speeds. The other configurations are similar to those in the first embodiment.

Effects of the above-described configuration are explained.

The continuous sheet feeding test was performed by changing the rotational speed of the developing roller relative to the rotational speed of the photosensitive drum in the surface coating image forming unit based on the operation in Example 1-1 in the above-described first embodiment. The results are shown in Table 3. The circumferential speed of the photosensitive drum is set to 252 mm/s.

First, in Example 3-1, with the same conditions as Example 1-1 in the first embodiment, the ratio of circumferential speed of the photosensitive drum and the developing roller was set to 1:1.02. Therefore, the circumferential speed of the developing roller was faster than the circumferential speed of the photosensitive drum. The test was performed by continuously feeding 50,000 sheets.

As a result, the amount of film reduction of the photosensitive drum was 5 μm, and the printed images were fine after the test.

Next, in Example 3-2, with the same conditions as Example 1-1 in the first embodiment, the ratio of circumferential speed of the photosensitive drum and the developing roller was set to 1:1.15. Therefore, the circumferential speed of the developing roller was faster than the circumferential speed of the photosensitive drum. The test was performed by continuously feeding 50,000 sheets.

As a result, the amount of film reduction was 7 μm, and the printed images were fine after the test.

Next, in Example 3-3, with the same conditions as Example 1-1 in the first embodiment, the ratio of circumferential speed of the photosensitive drum and the developing roller was set to 1:1.22. Therefore, the circumferential speed of the developing roller was faster than the circumferential speed of the photosensitive drum. The test was performed by continuously feeding 50,000 sheets.

As a result, the amount of film reduction was 9 μm, and the printed images were fine after the test. The film thickness of the photosensitive drum for the surface coating image forming unit after the test was 11 μm, which was the same as the film thickness of the photosensitive drum for the cyan image forming unit, which had the largest film reduction after the test among photosensitive drums for the KYMC image forming units.

Next, in Comparative Example 3-1, with the same conditions as Example 1-1 in the first embodiment, the ratio of circumferential speed of the photosensitive drum and the developing roller was set to 1:1.27. Therefore, the circumferential speed of the developing roller was faster than the circumferential speed of the photosensitive drum. The test was performed by continuously feeding 50,000 sheets.

As a result, the amount of film reduction was 10 μm, and the film thickness of the photosensitive drum was 10 μm. The

TABLE 3

| | Ratio of Rotational Speed of Developing Roller when Circumferential Speed of Photosensitive Drum is 1 | Film Thickness of Photosensitive Drum (μm) Before | After | Film Reduction | Uneven Glossiness | Life of Image Forming Unit |
|---|---|---|---|---|---|---|
| Example 3-1 | 1.02 | 20 | 15 | 5 | ○ | Equal to or More Than KYMC ○ |
| Example 3-2 | 1.15 | 20 | 13 | 7 | ○ | Equal to or More Than KYMC ○ |
| Example 3-3 | 1.22 | 20 | 11 | 9 | ○ | Equal to or More Than KYMC ○ |
| Comparative Example 3-1 | 1.27 | 20 | 10 | 10 | ○ | Equal to or Less Than KYMC X |
| Comparative Example 3-2 | 1.41 | 20 | 8 | 12 | ○ | Equal to or Less Than KYMC X |
| Comparative Example 3-3 | 0.93 | 20 | 14 | 6 | X | Equal to or Less Than KYMC X |

printed images were fine after the test. However the film thickness of the photosensitive drum was less than the film thickness of the photosensitive drums for the KYMC image forming units.

Next, in Comparative Example 3-2, with the same conditions as Example 1-1 in the first embodiment, the ratio of circumferential speed of the photosensitive drum and the developing roller was set to 1:1.41. Therefore, the circumferential speed of the developing roller was faster than the circumferential speed of the photosensitive drum. The test was performed by continuously feeding 50,000 sheets.

As a result, the amount of film reduction was 12 μm, and the film thickness of the photosensitive drum was 8 μm. The printed images were fine after the test. Image defects were not found in the printed images immediately after the commencement of the test.

For the printed image after the test, the surface coating toner was developed on the edges of the sheet that are non-print areas, causing uneven glossiness on the edges and thus image defects. Moreover, the surface coating toner was transferred on the transferring belt after passing the (T) image forming unit. The surface coating toner exited from the image forming unit without control. This leads to an assumption that unnecessary toner consumption increased because insulation breakdown occurred at a part of the photosensitive drum with low film thickness, causing the surface coating toner to exit from the image forming unit.

Next, in Comparative Example 3-3, with the same conditions as Example 1-1 in the first embodiment, the ratio of circumferential speed of the photosensitive drum and the developing roller was set to 1:0.93. Therefore, the circumferential speed of the developing roller was slower than the circumferential speed of the photosensitive drum. The test was performed by continuously feeding 50,000 sheets.

As a result, the amount of film reduction was 6 μm. Uneven glossiness was observed on the printed images from the beginning to the end of the test. This is assumed to have resulted from an insufficient amount of development by the surface coating toner due to low circumferential speed of the developing roller, which resulted in uneven glossiness on the images.

As discussed above, in the third embodiment, there is an advantage that the film reduction of the photosensitive drum can be suppressed by setting the ratio of circumferential speed of the photosensitive drum and the developing roller for the surface coating image forming unit to 1:1.02-1:1.22. In addition, there is an advantage to extend the life of the photosensitive drum for the surface coating image formation unit to a life similar to that of the photosensitive drums for the other KYCM image forming units.

The present invention was described with a printer as the image forming device. However, the present invention is not limited to printers but may be applied in facsimile machines, photocopy machines and multi-functional peripherals (MFP).

What is claimed is:

1. An image forming device, comprising:

a plurality of image forming units each including:

a developer carrier that carries developer;

an image carrier that forms an electrostatic latent image by being charged by a charge device and exposed to an exposure device, and that forms a developer image on a surface layer by attaching the developer supplied from the developer carrier onto the electrostatic latent image formed thereon; and a developer collector that is positioned to contact the surface layer of the image carrier and that removes residual developer after transferring the developer image formed on the surface layer onto a recording sheet, wherein the developer collector in a first image forming unit has a higher linear contact pressure against the surface layer of the image carrier than that of other image forming units, and a thickness of the surface layer of the image carrier of the first image forming unit is greater than a thickness of the surface layer of the image carrier of the other image forming units.

2. The image forming device of claim 1, wherein the thickness of the surface layer of the image carrier for the first image forming unit is equal to or greater than 20 μm and equal to or less than 30 μm.

3. The image forming device of claim 1, wherein the first image forming unit includes coating developer for coating a surface of the recording sheet.

4. The image forming device of claim 3, wherein the other image forming units include color developer for coloring.

5. The image forming device of claim 4, wherein the coating developer is transferred onto the color developer on the recording sheet.

6. The image forming device of claim 1, wherein the first image forming unit is downstream of the other image forming units.

7. The image forming device of claim 1, wherein the surface layer of the image carrier is a photoconductive layer.

8. The image forming device of claim 7, wherein the photoconductive layer includes a charge generating layer and a charge transporting layer.

9. The image forming device of claim 1, wherein the image carrier includes a conductive base material, and the surface layer is provided on a circumferential surface of the conductive base material.

10. The image forming device of claim 9, wherein the conductive base material is an aluminum cylinder.

11. The image forming device of claim 1, wherein the developer collector is a blade formed by urethane rubber.

12. The image forming device of claim 1, wherein the developer carrier of the first image forming unit is separable from the image carrier.

13. The image forming device of claim 1, wherein a ratio of circumferential speed of the image carrier and circumferential speed of the developer carrier of the first image forming unit is between 1:1.02 and 1:1.22.

14. An image forming device, comprising:

a plurality of image forming units, which are spaced apart in a sheet conveying direction of the image forming device, wherein each image forming unit includes a developer carrier, which carries developer;

an image carrier, wherein an electrostatic latent image is formed on a surface layer of the image carrier by being charged by a charge device and exposed to an exposure device, and a developer image is formed on the surface layer of the image carrier by attaching the developer supplied from the developer carrier onto the electrostatic latent image formed thereon; and a developer collector, which contacts the surface layer of the image carrier to remove residual developer after the developer image formed on the surface layer is transferred onto a recording sheet, wherein the developer collector in a downstream most one of the image forming units has a higher linear contact pressure against the surface layer of the image carrier than that of other image forming units, and a thickness of the surface layer of the image carrier of the downstream most image forming unit is greater than that of any other image forming unit of the plurality of image forming units.

15. The image forming device of claim 14, wherein the downstream most image forming unit is a coating developer for coating a colored image formed on the recording sheet.

16. The image forming device of claim 15, wherein other than the coating developer of the downstream most image forming unit, the image forming units apply colored developer.

17. The image forming device of claim 14, wherein the developer carrier of the downstream most image forming unit is constructed and arranged to separate from the image carrier to reduce wear on the image carrier.

18. The image forming device of claim 14, wherein a circumferential speed of the image carrier is less than that of a circumferential speed of the developer carrier in the downstream most image forming unit so that a circumferential surface of the developer carrier slides with respect to a circumferential surface of the image carrier.

19. The image forming device of claim 1, wherein the first image forming unit is configured to form an image at a lower resolution than a resolution of images formed by the other image forming units.

20. The image forming device of claim 1, wherein the linear contact pressure of the developer collector in the first image forming unit is about 1.5 times higher than that of the other image forming units.

21. The image forming device of claim 14, wherein the downstream most one of the image forming units is configured to form an image at a lower resolution than a resolution of images formed by the other image forming units.

22. The image forming device of claim 14, wherein the linear contact pressure of the developer collector in the downstream most one of the image forming units is about 1.5 times higher than that of the other image forming units.

* * * * *